US005772049A

United States Patent [19]

Randone

[11] Patent Number: 5,772,049

[45] Date of Patent: Jun. 30, 1998

[54] HAT SUPPORT APPARATUS

[76] Inventor: Mark J. Randone, 1223 N. Kansas Ave., Hastings, Nebr. 68901

[21] Appl. No.: 429,672

[22] Filed: Apr. 27, 1995

[51] Int. Cl.[6] ..... A47F 7/00

[52] U.S. Cl. ..... 211/30; 211/32; 211/33; 248/309.1

[58] Field of Search ..... 211/30, 31, 32, 211/119, 118, 33, 104, 87; 248/309.1, 175, 176.1

[56] References Cited

U.S. PATENT DOCUMENTS

| | | | |
|---|---|---|---|
| 698,263 | 4/1902 | Curry | 211/32 X |
| 941,653 | 11/1909 | Rothengatter | 211/104 X |
| 1,491,122 | 4/1924 | Wallace | 211/32 X |
| 2,108,678 | 2/1938 | Kulhawy | 211/32 |
| 2,146,109 | 2/1939 | Curtis, Jr. | 211/32 |
| 2,295,370 | 9/1942 | Witt | 211/32 X |
| 2,761,644 | 9/1956 | Capocci | 248/303 |
| 2,994,436 | 8/1961 | Stull et al. | 211/30 |
| 3,208,597 | 9/1965 | Hansen | 211/32 |
| 3,547,392 | 12/1970 | Tanzer | 248/360 |
| 3,780,971 | 12/1973 | Filipps | 211/104 X |
| 4,712,692 | 12/1987 | Peinsipp | 211/119 |
| 5,033,660 | 7/1991 | Kelly | 223/85 |
| 5,054,628 | 10/1991 | Allen | 211/104 |
| 5,092,472 | 3/1992 | Jones | 211/30 |
| 5,169,007 | 12/1992 | McHendry | 211/32 |

FOREIGN PATENT DOCUMENTS

| | | | |
|---|---|---|---|
| 182846 | 8/1955 | Austria . | |
| 498014 | 12/1953 | Canada . | |
| 3300125 | 7/1983 | Germany | 211/32 |

*Primary Examiner*—Robert W. Gibson, Jr.
*Attorney, Agent, or Firm*—John A. Beehner Law Office

[57] ABSTRACT

A collapsible hat support device adapted to support a hat having a crown and brim on a support surface. The support device comprises a base adapted for stable support on a substantially flat support surface and a continuous, elongated hat support arm pivotally connected to the base. The support arm is movable between a lowered storage position adjacent the base and a raised hat support position. The support arm is adapted to be received within and engage the interior portion of the hat crown for support of the hat with the brim in spaced relation from the support surface. A means for releasably securing the hat support arm in at least the raised hat support position is included. This securement means may be flexible wire connectors used to connect the arm to the base. At least one hook support member is operatively connected to the base for supporting the base from a nail, door top or other horizontal surface and against an upright surface.

11 Claims, 4 Drawing Sheets

HAT SUPPORT APPARATUS

BACKGROUND OF THE INVENTION

1. Technical Field

The apparatus of the present invention relates generally to an apparatus for supporting a hat. More specifically, it relates to an apparatus adapted to support a hat on both vertical and horizontal as well as inclined surfaces, while preventing any pressure contact between the hat and the support surface. The apparatus has application with all types of hats but is especially effective at addressing concerns associated with Western style or "cowboy hats".

It is an important consideration with expensive hats, especially those commonly referred to as "cowboy hats", that undue pressure not be applied to the brim of the hat. Such undue pressure can result from placing the hat directly on the surface of a table or other horizontal surface. This pressure can, over time, lead to a distortion in the hat's shape. Such concerns are enhanced when visiting out of town where the hotel may be totally lacking in means for supporting the hat. Therefore, it is highly desirable that a portable hat storage apparatus be provided which is able to store the hat without placing any pressure on the brim thereof.

2. Description of the Prior Art

Several prior art devices for assisting in the support of hats exist. However, frequently, these devices are adapted to work either in the vertical or horizontal planes, but not both. For example, Guthrie, U.S. Pat. No. 2,633,246, discloses a hat-supporting hook adapted for suspension from a wall or vertical surface for the support of a hat. The Guthrie apparatus has a base plate or mounting loop adapted for mounting on a vertical wall.

Another example of a prior art hat support apparatus is illustrated in Hotchkiss, U.S. Pat. No. 822,277. Hotchkiss discloses a hat support apparatus having a pair of circular wire members supported in spaced apart relation and adapted to be placed on a horizontal surface. The circular wire members are held in vertically spaced relation and the hat placed on top of the upper members.

These two prior art devices are illustrative of the state of the prior art in hat support apparatus. As can be seen from these two examples, the prior art is typified by devices which are adapted to be used in either a vertical fashion or a horizontal fashion but not both.

Consequently, it is a primary objective of the present hat support apparatus to provide a device which is capable of supporting a hat in either a horizontal or vertical orientation.

It is a further objective of the present invention to provide a hat support device which is adapted to position the hat above the support surface so as to prevent the application of any pressure to the hat brim, thereby preserving its shape.

It is a further objective of the present invention to provide an apparatus which is adaptable for use with any variety of hats, such as "cowboy hats", baseball caps and the like.

It is a further objective of the present invention to provide a hat support apparatus which may be used in a large number of environments such as hung from an automobile sun visor, window, gun rack, door, placed on a table or other horizontal surface or the like.

It is a further objective to provide a hat support apparatus of a construction allowing it to be hung from a set of nails, a single nail or hook.

It is a further objective of the present invention to provide an apparatus which is light weight and collapsible in nature such that it may be collapsed into a nearly planar arrangement for storage and then easily unfolded for use enhancing its portability.

It is a further objective to provide a hat support apparatus having at least one pivotally mounted support hook adapted to allow the apparatus to be hung from a variety of structures.

It is a further objective of the present invention to provide a hat support apparatus which may be hung together in a serial fashion one from the other, to provide a multiplicity of hat support positions for display of hats.

It is a final objective of the present invention to provide a hat support apparatus having a minimum number of parts of simple construction, minimizing the complexity of the apparatus and maximizing its useful life.

SUMMARY OF THE INVENTION

A collapsible hat support device adapted to support a hat having a crown and brim on a support surface. The support device comprises a base adapted for stable support on a substantially flat support surface and a continuous, elongated hat support arm pivotally connected to the base. The support arm is movable between a lowered storage position adjacent the base and a raised hat support position. The support arm is adapted to be received within and engage the interior portion of the hat crown for support of the hat with the brim in spaced relation from the support surface. A means for releasably securing the hat support arm in at least the raised hat support position is included. This securement means may be flexible wire connectors used to connect the arm to the base. At least one hook support member is operatively connected to the base for supporting the base from a nail, door top or other horizontal surface and against an upright surface.

BRIEF DESCRIPTION OF THE DRAWINGS

FIG. 4 is perspective view of the apparatus in use on a horizontal surface.

FIG. 5 is a view of the apparatus hung from a side window of a vehicle.

FIG. 6 is a view of the apparatus hung from a vehicle sun visor.

FIG. 7 is a view of the apparatus installed on a gun rack.

FIG. 8 is a view of the apparatus installed on a vertical support such as a closet door or the like.

FIG. 9 is a perspective view of the apparatus hung in a serial fashion, one from the other as might be desired when displaying hats for retail.

FIG. 10 is a view of the apparatus with the elongated hat support arm pivoted to the storage position such that the apparatus presents a substantially planar figure illustrated in this figure by its ability to be slidably received within an envelope.

FIG. 11 illustrates the support of another hat type such as a baseball cap.

DESCRIPTION OF THE PREFERRED EMBODIMENT

Figure 1:
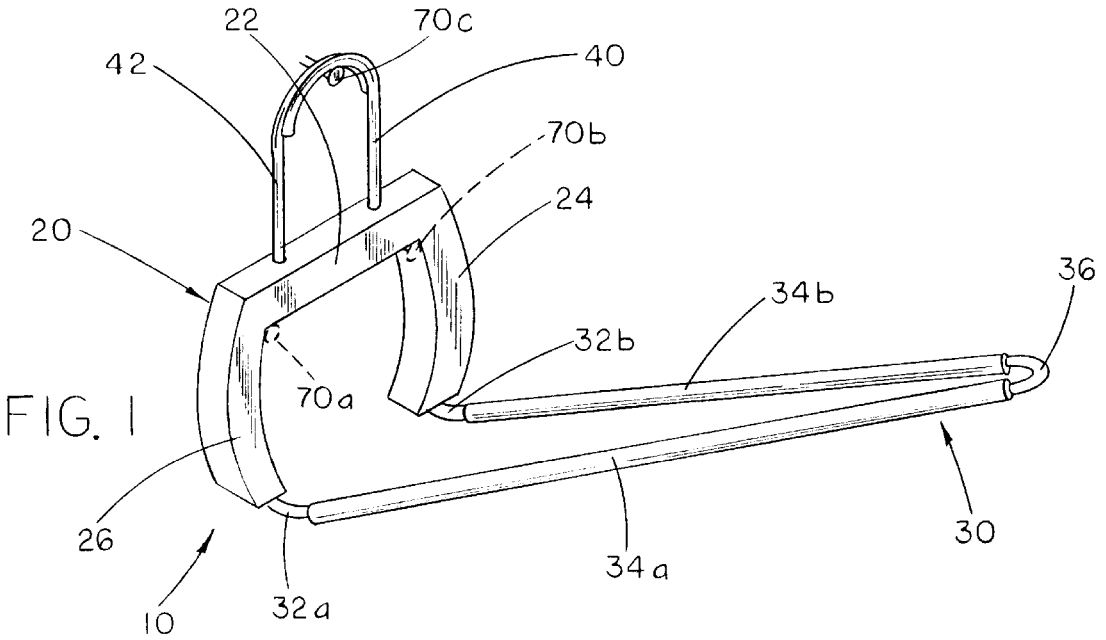
FIG. 1 is a perspective view of the apparatus hung from a support nail with the hat support arm pivoted outwardly to the hat support position.

As indicated in the perspective view of FIG. 1, the hat support apparatus 10 comprises a generally U-shaped base portion 20 which has connected thereto a hat support arm 30. As seen in the figure, the hat support arm 30 comprises a continuous elongated generally U-shaped loop which is secured to the base portion 20 by two connection members 32*a* and 32*b*. In the preferred embodiment, these two arm connection members 32*a* and 32*b* would be constructed of flexible wires such that a means is provided whereby the support arm 30 is easily movable between, and releasably retainable in, a collapsed lowered storage position adjacent the base portion 20 (FIG. 3) or pivoted outwardly as shown, into the raised hat support position. In the preferred embodiment, the hat support arm 30 would further comprise two separate sleeves 34*a* and 34*b*. In the preferred embodiment, sleeves 34*a* and 34*b* would be constructed of some larger diameter material such as wood dowels, plastic or the like. As seen in the figure, sleeves 34*a* and 34*b* are joined by connection member 36 to form the continuous hat support arm 30. The connection members 32*a* and 32*b* and 36 could be individual wire pieces or could be portions of a single continuous wire. In the preferred embodiment, connection members 32*a*, 32*b*, and 36 are individual wire pieces which are received within recesses in the base 20 and support sleeves 34*a* and 34*b* where they would be retained using glue or the like.

Also seen in this figure are a plurality of support hooks 40 and 42. As shown in the figure, support hooks 40 and 42 are adapted to be received in holes drilled in the top portion 22 of base unit 20. As shown in the figure, support hooks 40 and 42 comprise a bend in the upper portion thereof adapted to engage a nail (70*c*) or the top ledge or surface of a vertical edge as illustrated in FIGS. 5–9. In the preferred embodiment, hooks 40 and 42 are approximately one and one-quarter inches in diameter so that they will accommodated the width of a door or the like. Hooks 40 and 42 are slidably and rotatably supported in the top portion 22 of base 20 symmetrically about the centerline thereof. As also shown in FIG. 1, base portion 20 is constructed in a fashion which permits top portion 22 to engage a plurality of nails 70*a* and 70*b* on the inner surface thereof. Alternatively, the apparatus may be supported by a single nail with the hooks 40 and 42 turned inward to engage nails 70*c* as illustrated.

Figure 2:
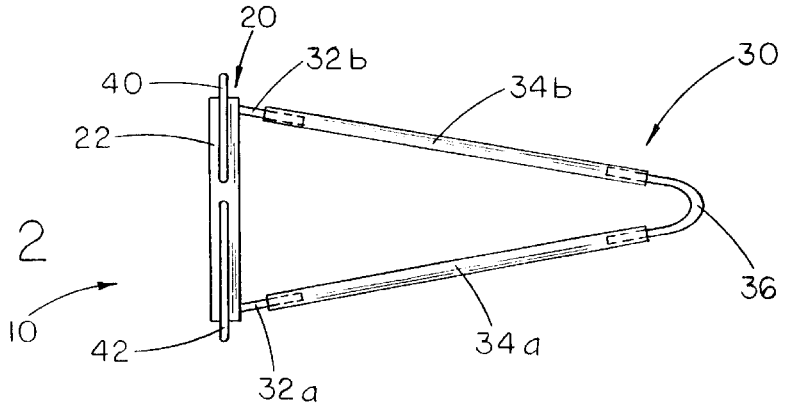
FIG. 2 is a top view of the apparatus with the support arm in the extended, hat support position.

FIG. 2 is a top view of the apparatus showing with particular clarity the closed loop nature of the continuous hat support arm 30. As seen in the figure, the support sleeves 34*a* and 34*b* are constructed of a material having a diameter slightly larger than the connection members 32*a* and 32*b*. As stated above, in the preferred embodiment, the support sleeves 34*a* and 34*b* would be constructed of a material such as wood plastic or the like. The purpose for having these support sleeves 34*a* and 34*b* of a slightly larger diameter is that it allows the weight from supporting the hat 80 to be distributed over a larger area thereby minimizing any pressure point on the hat brim 82. Finally, seen clearly in this view is the connecting member 36 joining sleeves 34*a* and 34*b* and forming the closed loop support arm 30. In the preferred embodiment, connection members 32*a*, 32*b* and 36 are constructed of individual wire pieces, sleeves 34*a* and 34*b*, having recesses drilled therein (shown in hidden lines) to receive the wire. Alternatively, if connection members 32*a* and 32*b* and 36 are formed from a single piece, sleeves 34*a* and 34*b* would simply have holes drilled therethrough to receive the wire.

Figure 3:
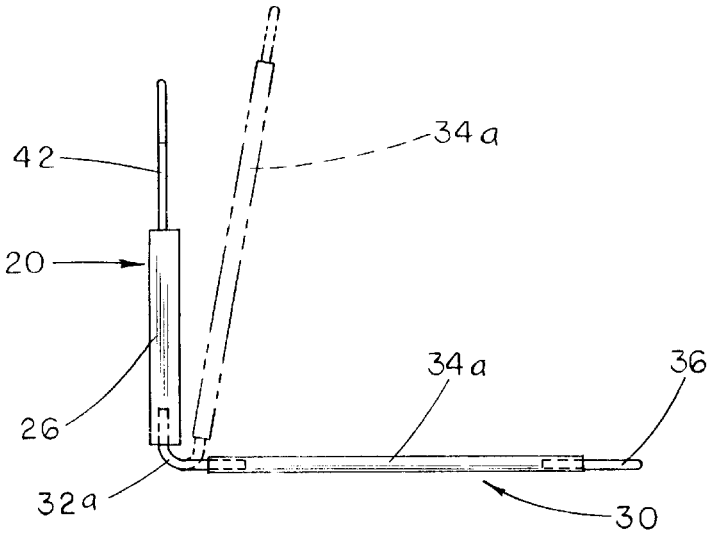
FIG. 3 is side view of the apparatus showing the elongated hat support arm in the extended hat support position in solid lines and in the folded storage position in phantom lines.
Figure 11:
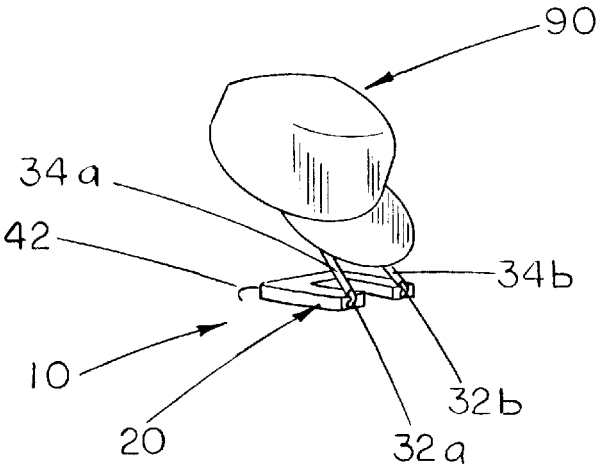

FIG. 3 is a side view of the hat support apparatus showing the movement of the hat support arm 30 between the two primary positions. The storage position is shown in phantom lines adjacent base portion 20. The extended hat support position is illustrated in solid lines. As mentioned above, for use in supporting a hat, it is anticipated that support arm 30 would be pivoted outwardly a sufficient distance such that a hat 80 supported thereby would not contact the support surface. Alternatively, for storage and transportation, it is anticipated that support arm 30 would be folded adjacent base 20 so that the apparatus is essentially flat. When so folded, the apparatus is sufficiently flat that it may be placed in a suitcase for transportation or even slipped into a coat pocket or envelope (FIG. 11).

Figure 4:
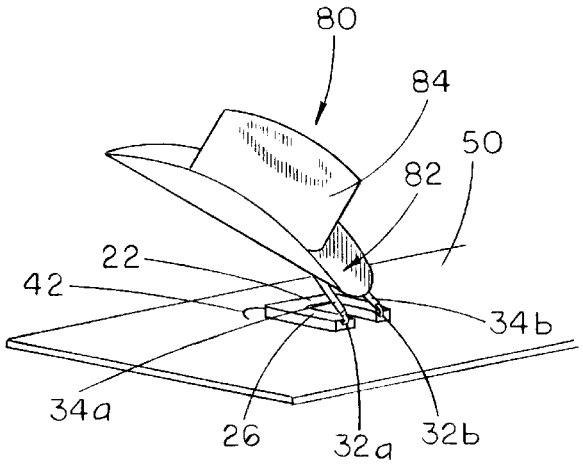
FIG. 4–11 show the apparatus in various uses.

FIG. 4 is a perspective view of the apparatus shown in the horizontal support position mode of operation. As seen in this figure, the base portion 20 of the apparatus 10 rests on a horizontal surface such as a table top 50 providing a support for the apparatus. It will be noted that support arm 30 has been pivoted upwardly sufficiently such that hat 80 is supported in a spaced relation from surface 50.

Figure 5:
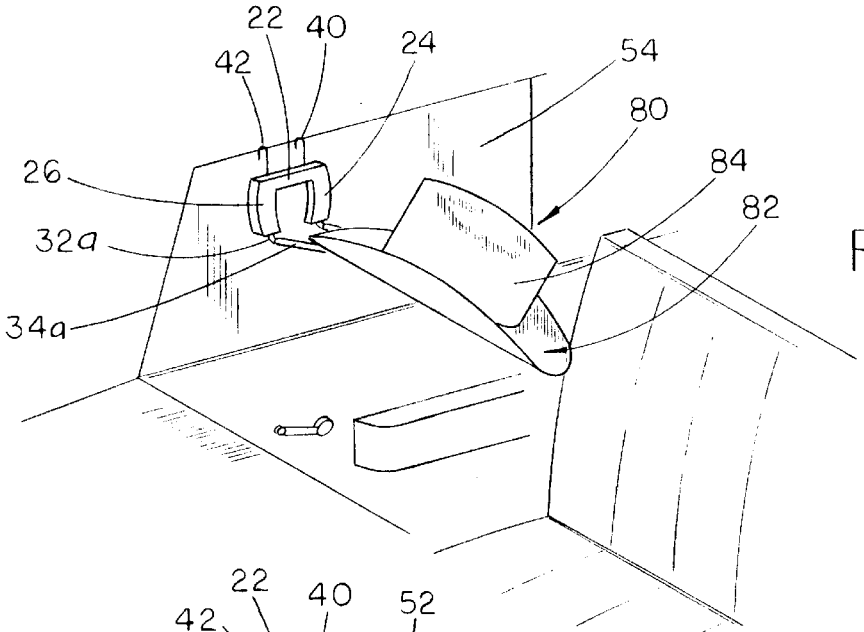

FIGS. 5–9 illustrate the use of the invention in various forms in a vertical orientation. FIG. 5 illustrates the use of the apparatus in supporting a hat from a window 54. As shown in the figure, the apparatus is vertically supported 80 from the window by means of hooks 40 and 42. As is typical of use of the invention in the vertical support mode, the hooks 40 and 42 are used to engage the top surface or edge of the vertical support surface, in this case, window 54. As also seen in this view, support arm 30 is positioned such that hat 80 and specifically brim 82, does not contact the surface of window 54. Due to the orientation of hooks 40 and 42 in combination with the leverage provided by the weight of hat 80 on arm 30, the base 20 of the support apparatus 10 is urged against the surface of window 54.

Figure 6:
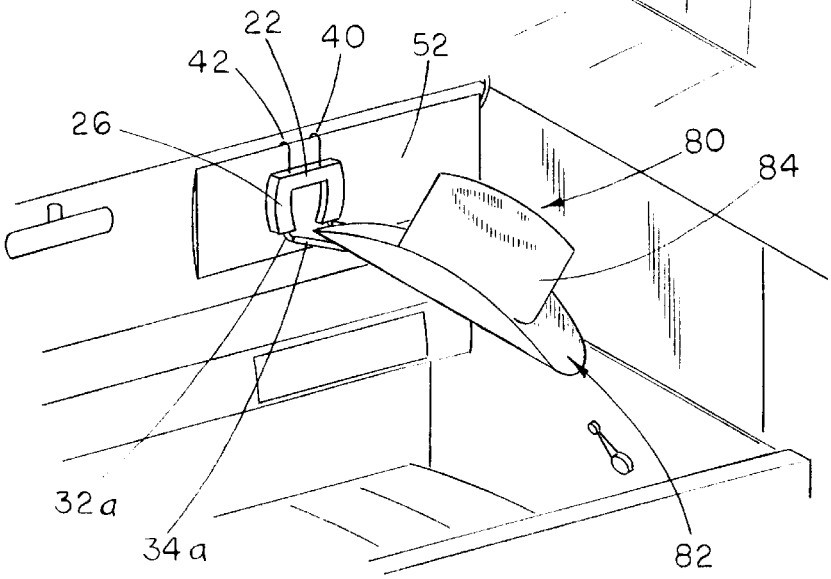

FIG. 6 illustrates yet another unique use of the support apparatus 10 in the vertical orientation. As seen in this figure, the vertical member used to support the apparatus is a sun visor 52 of a vehicle. The manner of use here is very similar to that in FIG. 5 above except that hooks 40 and 42 engage the top edge of a visor 52 rather than a window as in FIG. 5. Again, the weight of hat 80 on arm 30 will urge base 20 into contact with visor 52, thereby creating a degree of rigidity to the system.

Figure 7:
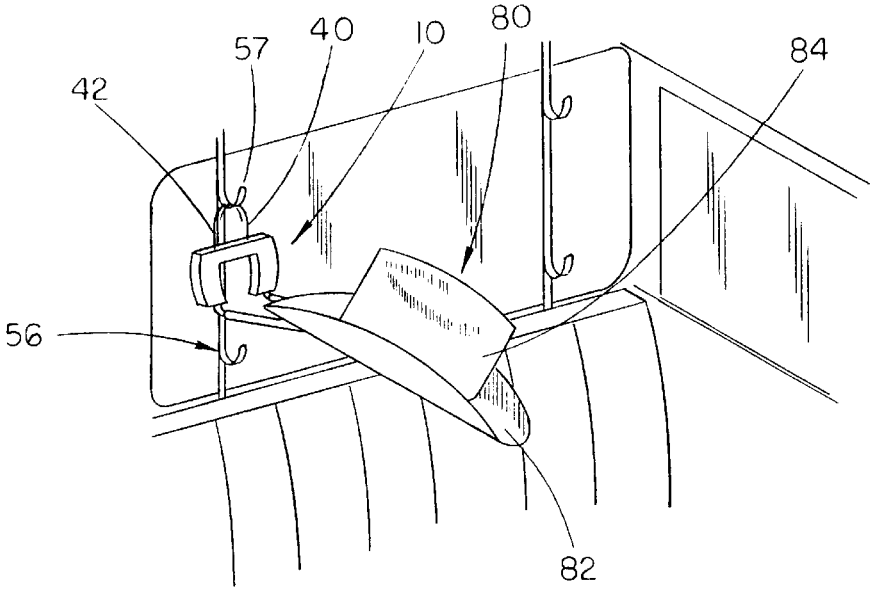

FIG. 7 illustrates yet another embodiment wherein the hat support apparatus 10 is used in the vertical support mode. In this illustration, the apparatus 10 is shown hanging from a gun rack 56. As can be seen from the figure, the support hooks 40 and 42 would be used to engage one of the gun support members 57 as shown. When the apparatus is hung from a projection such as gun support member 57, as opposed to a window or other elongated surface, the hooks 40 and 42 would be turned inwardly as shown so that they can both engage the support member (see also FIG. 1). The support arm 30 is otherwise inserted into the interior portion defined by the hat crown 84 as previously discussed.

Figure 8:
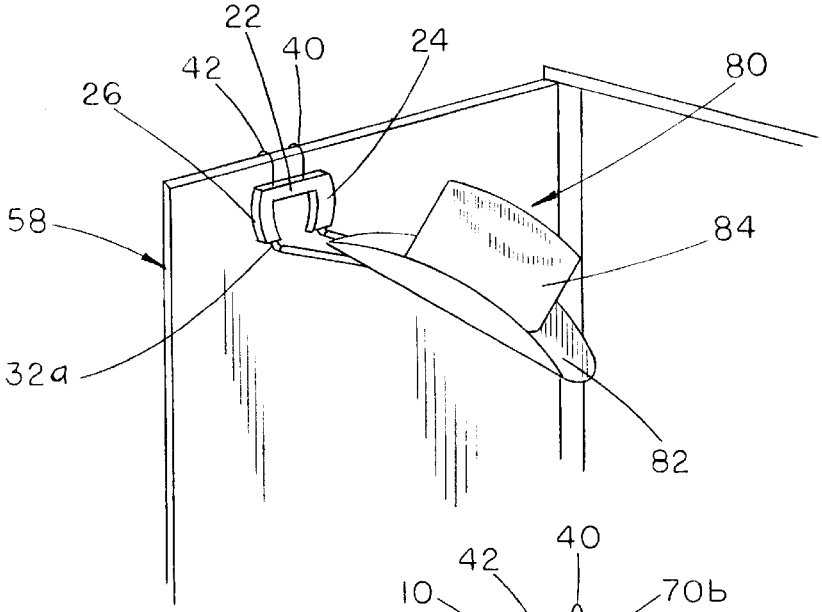

FIG. 8 is another illustration of the hat support apparatus 10 in the vertical support mode wherein the support hooks 40 and 42 have been used to engage the top surface of a door 58. The method of supporting the apparatus 10 is the same as that described in connection with window 54 and visor 52 above wherein hooks 40 and 42 are used to engage the top edge of door 58. The weight of hat 80 on arm 30 urges base 20 against door 58, providing a degree of rigidity to the support system.

Figure 9:
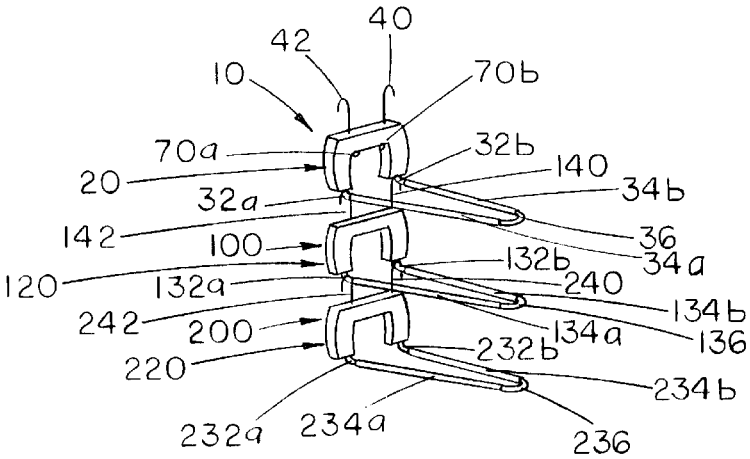

FIG. 9 illustrates how a single support 10 is used to support a plurality of additional hat supports such as 100 and

200 which may be hung one from the other. As seen in the figure, the support hooks 140/142 and 240/242 of hat supports 100 and 200, respectively, engage the arm connection members 32*a*/32*b* and 132*a*/132*b* of the supports 10 and 100, respectively. Thus, even with a single set of nails 70*a* and 70*b* in the wall, a multitude of hat support apparati can be utilized. This may be particularly useful either in a retail situation to display hats or for the person who owns several hats.

Figure 10:
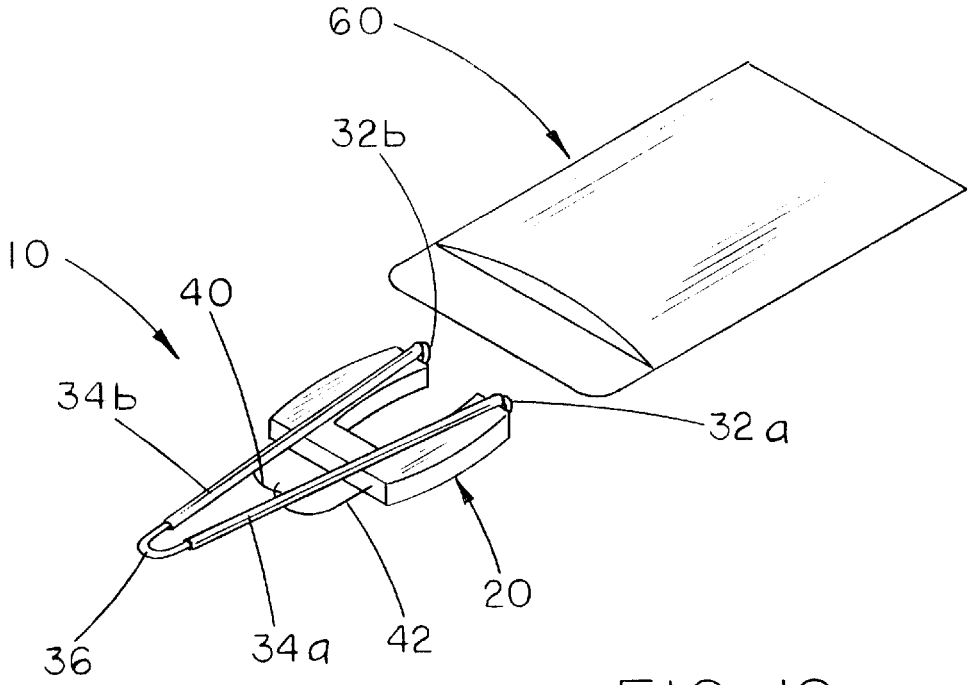

FIG. 10 illustrates the extremely compact nature of the apparatus when the hat support arm 30 is folded into the storage position adjacent base portion 20. As mentioned above, when the support arm 30 is so positioned, the apparatus assumes a substantially planar figure (see FIG. 3). The device when so positioned is sufficiently compact that it may be inserted into the sleeve of an envelope 60 as indicated in FIG. 10. Additionally, the apparatus in the closed storage position may be easily accommodated in a suitcase for travel without consuming a great deal of space.

Finally, FIG. 11 illustrates the versatility of the present apparatus and its ability to support many different varieties of hats. As illustrated, the device is not limited to use with cowboy hats but rather is equally well suited to support a variety of hats such as a conventional baseball cap 90 as indicated.

It is obvious that numerous other modifications and variations of the present invention are possible in view of the above teachings. For example, since the support arm 30 is constructed in the form of a closed loop, it is easily adapted to store and support items other than hats. For example, in the vertical support mode, the support arms 30 may be bent to a substantially parallel relation to the floor and items such as ties, belts, and the like may be draped over the support sleeves 34*a* and 34*b* or over a hat being supported thereon. Additionally, as mentioned above, the apparatus when folded in ○ the closed storage position is sufficiently small for compact storage in an envelope, suitcase or the like. In fact, the apparatus is sufficiently small that it may even be carried in the breast pocket of a conventional jacket.

Therefore it is to be understood that the above description is in no way intended to limit the scope of protection of the claims and is representative only of the several possible embodiments of the present invention.

There has thus been shown and described an invention which accomplishes at least all of the stated objects.

I claim:

1. A collapsible hat support apparatus adapted to support a hat having a crown and brim on a support surface, the crown defining an interior portion of the hat, the support apparatus comprising:

a base adapted for stable support on substantially flat support horizontal and vertical support surfaces;

a continuous, elongated hat support arm pivotally connected to said base and movable between a lowered storage position adjacent said base and a raised hat support position said support arm adapted to be received within and engage the interior portion of the crown of the hat for support of said hat with said brim in spaced relation from said support surface;

means for releasably securing said hat support arm in at least the raised hat support position; and at least one hook support member operatively connected to said base for supporting said base against an upright surface.

2. The collapsible hat support apparatus of claim 1 wherein said continuous, elongated hat support arm is generally U-shaped.

3. The collapsible hat support apparatus adapted to support a hat having a crown and brim on a support surface, the crown defining an interior portion of the hat, the support apparatus comprising:

a base adapted for stable support on a substantially flat support surface;

a continuous, elongated hat support arm pivotally connected to said base and movable between a lowered storage position adjacent said base and a raised hat support position said support arm adapted to be received within and engage the interior portion of the crown of the hat for support of said hat with said brim in spaced relation from said support surface;

means for releasably securing said hat support arm in at least the raised hat support position; and two hooks for stable support of said hook support apparatus, said hooks being rotatably mounted on said base and operatively connected to said base for supporting said base against an upright surface.

4. The collapsible hat support apparatus of claim 3 wherein said hooks are symmetrically arranged relative to the centerline of said base.

5. The collapsible hat support apparatus of claim 3 wherein said hooks are at least one and one-quarter inches diameter such that said hooks are adapted to releasably engage a door top.

6. The collapsible hat support apparatus of claim 1 wherein said elongated hat support arm is generally rigid and connected to said base by a flexible connector.

7. The collapsible hat support apparatus of claim 1 wherein said hat support arm comprises a pair of solid dowels connected to said base by a flexible connector comprising a plurality of wires secured to said dowels.

8. The collapsible hat support apparatus of claim 1 wherein said base is generally U-shaped.

9. The collapsible hat support apparatus of claim 3 wherein said hooks are slidably supported relative to said base for movement between an extended support position and a retracted storage position.

10. In combination, a hat having a crown and brim, the crown defining an interior portion of the hat, a collapsible hat support apparatus for supporting the hat having, a base adapted for stable support on substantially flat horizontal and vertical support surfaces, a continuous, elongated hat support arm pivotally connected to said base and movable between a lowered storage position adjacent said base and a raised hat support position said support arm adapted to be received within and engage the interior portion of the crown of the hat for support of said hat with said brim in spaced relation from said support surface, means for releasably securing said hat support arm in at least the raised hat support position, at least one hook support member operatively connected to said base for supporting said base against an upright surface.

11. A collapsible hat support apparatus adapted to support a hat having a crown and brim on a support surface, the crown defining an interior portion of the hat, the support apparatus comprising:

a generally U-shaped base adapted for stable support on a substantially flat support surface having a top and first and second side members and a base centerline being defined as the line equidistant between said side members;

a continuous, elongated hat support arm comprising a pair of dowels connected by a piece of wire and held in spaced apart relation, each of said dowels being connected to a respective one of said base first and second side members by first and second flexible wire connectors, said connectors allowing said support arm to be moved between and releasably retained in a lowered storage position adjacent said base and a raised hat support position, said support arm adapted to be received within and engage the interior portion of the crown of the hat for support of said hat with said brim in spaced relation from said support surface; and a pair of support hooks slidably and rotatably supported on said top of said base, symmetrically about said centerline for supporting said base against an upright surface.

* * * * *